US008728997B2

(12) United States Patent
Kurosawa et al.

(10) Patent No.: US 8,728,997 B2
(45) Date of Patent: May 20, 2014

(54) LUBRICATING OIL COMPOSITION

(75) Inventors: Osamu Kurosawa, Yokohama (JP); Masaaki Itou, Yokohama (JP); Masato Takahashi, Yokohama (JP)

(73) Assignee: Nippon Oil Corporation, Tokyo (JP)

( * ) Notice: Subject to any disclaimer, the term of this patent is extended or adjusted under 35 U.S.C. 154(b) by 59 days.

(21) Appl. No.: 12/297,531

(22) PCT Filed: Apr. 19, 2007

(86) PCT No.: PCT/JP2007/059005

§ 371 (c)(1),
(2), (4) Date: Oct. 17, 2008

(87) PCT Pub. No.: WO2007/123266

PCT Pub. Date: Nov. 1, 2007

(65) Prior Publication Data

US 2009/0131291 A1 May 21, 2009

(30) Foreign Application Priority Data

Apr. 20, 2006 (JP) ..... 2006-116556

(51) Int. Cl.
*C10M 145/14* (2006.01)
*C10M 137/10* (2006.01)

(52) U.S. Cl.
USPC ..... 508/469; 508/583; 508/371; 508/291

(58) Field of Classification Search
USPC ..... 508/583, 469, 371, 291
See application file for complete search history.

(56) References Cited

U.S. PATENT DOCUMENTS

| | | | | |
|---|---|---|---|---|
| 5,188,770 | A | 2/1993 | Pennewiss | |
| 5,391,307 | A | 2/1995 | Yamazaki et al. | |
| 5,641,732 | A | 6/1997 | Bloch et al. | |
| 5,688,748 | A * | 11/1997 | Tomizawa | 508/363 |
| 5,744,430 | A | 4/1998 | Inoue et al. | |
| 5,969,068 | A | 10/1999 | Bryant et al. | |
| 6,133,210 | A * | 10/2000 | Tipton | 508/469 |
| 6,225,266 | B1 | 5/2001 | Watts et al. | |
| 6,329,328 | B1 * | 12/2001 | Koganei et al. | 508/365 |
| 6,613,722 | B1 | 9/2003 | Watts et al. | |
| 7,737,092 | B2 | 6/2010 | Ward, Jr. et al. | |
| 2001/0027169 | A1 | 10/2001 | Kurihara et al. | |
| 2001/0044389 | A1 | 11/2001 | Komiya et al. | |
| 2002/0072478 | A1 | 6/2002 | Ishida et al. | |
| 2003/0104955 | A1 | 6/2003 | Yuki et al. | |
| 2003/0162673 | A1 * | 8/2003 | Kurihara et al. | 508/364 |
| 2004/0043910 | A1 | 3/2004 | Lok et al. | |
| 2004/0176256 | A1 | 9/2004 | Kurosawa et al. | |
| 2004/0192562 | A1 | 9/2004 | Morita | |
| 2006/0105921 | A1 | 5/2006 | Arimoto et al. | |
| 2006/0135378 | A1 * | 6/2006 | Takahashi et al. | 508/433 |

FOREIGN PATENT DOCUMENTS

| | | | |
|---|---|---|---|
| EP | 0418610 | A1 | 3/1991 |
| EP | 1559772 | A1 | 8/2005 |
| JP | 3-39399 | A | 2/1991 |
| JP | 07-268375 | A | 10/1995 |
| JP | 09-003131 | A | 1/1997 |
| JP | 11-181464 | A | 7/1999 |
| JP | 2000-063869 | A | 2/2000 |
| JP | 2000-087070 | A | 3/2000 |
| JP | 2001-181664 | A | 7/2001 |
| JP | 2001-262176 | A | 9/2001 |
| JP | 2002-003876 | A | 1/2002 |
| JP | 2002-012884 | A | 1/2002 |
| JP | 2002-220597 | A | 8/2002 |
| JP | 2002-371292 | A | 12/2002 |
| JP | 2004-010799 | A | 1/2004 |
| JP | 2004-155873 | A | 6/2004 |
| JP | 2004-155924 | A | 6/2004 |
| JP | 2004-169025 | A | 6/2004 |
| JP | 2004-307551 | A | 11/2004 |
| JP | 2005-154760 | A | 6/2005 |
| WO | 2004074414 | A1 | 9/2004 |
| WO | WO 2004074414 | A1 * | 9/2004 |

OTHER PUBLICATIONS

EP Supplementary Search Report issued Nov. 15, 2010 in counterpart EP Application No. 07 74 2440.
Int'l Search Report issued on Jan. 31, 2006 in Int'l Application No. PCT/JP2005/019644 (English Translation attached).
EP Supplemental Search Report issued on Oct. 27, 2008 in EP Application No. 05 79 9398.
U.S. Office Action issued Nov. 29, 2010 in U.S. Appl. No. 11/737,339.
U.S. Appl. No. 11/737,339, filed Apr. 19, 2007.
U.S. Office Action issued May 3, 2010 in U.S. Appl. No. 11/737,339.
U.S. Appl. No. 13/103,582, filed May 9, 2011.
U.S. Office Action issued Nov. 30, 2012 in U.S. Appl. No. 13/103,582.
U.S. Office Action issued Aug. 20, 2013 in U.S. Appl. No. 11/737,339.
U.S. Office Action issued May 14, 2012 in U.S. Appl. No. 13/103,582.

* cited by examiner

*Primary Examiner* — Jim Goloboy
(74) *Attorney, Agent, or Firm* — Panitch Schwarze Belisario & Nadel LLP

(57) ABSTRACT

The present invention provides a lubricating oil composition which is less in evaporation loss even having a low viscosity and excellent in lubricating properties such as low-temperature viscosity characteristics and anti-seizure properties and in oxidation stability, suitable for use in engines, automatic transmissions, manual transmissions, final reduction gear units, and continuously variable transmissions. The lubricating oil composition comprises (A) a lubricating base oil and (B) a poly(meth)acrylate additive in such an amount that the kinematic viscosity at 100° C. of the composition (Vc) is from 3 to 15 $mm^2/s$, the viscosity index of the composition is from 95 to 200, and the ratio of the kinematic viscosity at 100° C. of (A) the lubricating base oil (Vb) to (Vc) (=Vb/Vc) is 0.60 or greater, further, (C) a metallic detergent, (D) an ashless dispersant and (E) zinc dithiophosphate, each in a specific amount.

8 Claims, No Drawings

LUBRICATING OIL COMPOSITION

CROSS-REFERENCE TO RELATED APPLICATION

This application is a section 371 of International Application No. PCT/JP2007/059005, filed Apr. 19, 2007, which was published in the Japanese language on Nov. 1, 2007 under International Publication No. WO 2007/123266 A1 and the disclosure of which is incorporated herein by reference.

FIELD OF THE INVENTION

The present invention relates to lubricating oil compositions, more specifically such compositions that are low in evaporation loss even having a low viscosity and excellent in lubricating properties such as low-temperature viscosity characteristics and anti-seizure properties and oxidation stability, suitable for use in engines, automatic transmissions, manual transmissions, final reduction gear units, and continuously variable transmissions.

BACKGROUND OF THE INVENTION

In recent years, from the viewpoint of dealing with environmental issues such as reduction of carbon dioxide emission, there has arisen an urgent need that automobiles, construction machines and agricultural machines consume less energy, i.e., are reduced in the fuel-consumption thereof. In particular, there is a growing demand that their units such as engines, transmissions, final reduction gear units, compressors and hydraulic equipment contribute to energy saving. Therefore, lubricating oils used in these units have been demanded to be less in frictional loss by agitation and frictional resistance than ever before.

Lowering the viscosity of a lubricating oil may be exemplified as a means for allowing a transmission and a final reduction gear unit to contribute to fuel saving. For example, an automobile automatic transmission or continuously variable transmission has a torque converter, a wet clutch, a gear bearing mechanism, an oil pump and a hydraulic control system while a manual transmission or final reduction gear unit has a gear bearing mechanism. Lowering the viscosity of a lubricating oil to be used in such transmissions can reduce the frictional loss by agitation and frictional resistances of the torque converter, wet clutch, gear bearing mechanism and oil pump and thus enhance the power transmission efficiency thereof, resulting in an improvement in the fuel economy performance of the automobile.

However, when lubricating oil to be used in these transmissions is lowered in viscosity, it will be excellent in low-temperature viscosity characteristics but will be extremely increased in evaporation loss and poor in lubricating properties. As the result, seizure occurs in the engine or transmission and thus may cause some malfunctions therein.

Examples of conventional automobile transmission oils which enables a transmission to maintain various properties such as shifting properties for a long time include those produced by, optimizing and blending synthetic and/or mineral base oils, antiwear agents, extreme pressure additives, metallic detergents, ashless dispersants, friction modifiers and viscosity index improvers (for example, see Patent Document Nos. 1 to 4 below). However, these compositions are not aimed at improving the fuel saving performance of an automobile and thus are high in kinematic viscosity. Any of the documents does not refer to effects on lubricating properties obtained by lowering the viscosity of lubricating oil at all.

Therefore, a composition which can solve the foregoing problems has not been sufficiently studied yet.

(1) Japanese Patent Application Laid-Open Publication No. 3-39399

(2) Japanese Patent Application Laid-Open Publication No. 7-268375

(3) Japanese Patent Application Laid-Open Publication No. 2000-63869

(4) Japanese Patent Application Laid-Open Publication No. 2001-262176

DISCLOSURE OF THE INVENTION

The present invention was made in view of the foregoing situations and intends to provide a lubricating oil composition which is less in evaporation loss even having a lower viscosity and excellent in lubricating properties such as low temperature viscosity characteristics and anti-seizure properties and oxidation stability, in particular a lubricating oil composition with fuel saving properties and properties to provide gears or bearings with sufficient durability, suitable for use in automobile engines, automatic transmissions, manual transmissions and continuously variable transmissions.

As a result of an extensive study and research conducted for solving the above-described problems, focusing on lubricating base oils and polymers, the present invention was achieved on the basis of the finding that the foregoing problems were able to be solved with a lubricating oil composition comprising a base oil, a poly(meth)acrylate additive to be added so that specific viscosity characteristics are attained, and predetermined additives.

That is, the present invention relates to a lubricating oil composition comprising (A) a lubricating base oil (hereinafter may be referred to as "Component (A)") and (B) a poly (meth)acrylate additive (hereinafter may be referred to as "Component (B)") in such an amount that the kinematic viscosity at 100° C. of the composition (Vc) is from 3 to 15 $mm^2/s$, the viscosity index of the composition is from 95 to 200, and the ratio of the kinematic viscosity at 100° C. of (A) the lubricating base oil (Vb) to (Vc) (=Vb/Vc) is 0.60 or greater, further, on the basis of the total mass of the composition, (C) a metallic detergent (hereinafter may be referred to as "Component (C)") in an amount of 0.03 to 0.5 percent by mass in terms of metal, (D) an ashless dispersant (hereinafter may be referred to as "Component (D)") in an amount of 0.005 to 0.15 percent by mass in terms of nitrogen and (E) zinc dithiophosphate (hereinafter may be referred to as "Component (E)") in an amount of 0.02 to 0.3 percent by mass in terms of phosphorus.

The present invention also relates to the foregoing lubricating oil composition, wherein Component (B) is (B1) a poly(meth)acrylate additive (hereinafter may be referred to as "Component (B1)") with a weight average molecular weight of 50,000 to 300,000.

The present invention also relates to the foregoing lubricating oil composition, wherein the Mw/Mn of Component (B1) is 1.5 or greater.

The present invention also relates to the foregoing composition, wherein Component (B1) comprises a poly(meth) acrylate containing only a structural unit represented by formula (1):

(1)

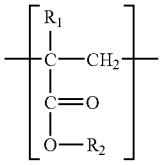

wherein $R_1$ is hydrogen or methyl, $R_2$ is a hydrocarbon group having 5 to 20 carbon atoms or a moiety represented by —$(R)_a$-E wherein R is an alkylene group having 5 to 20 carbon atoms, E is an amine moiety or heterocyclic moiety having 1 or 2 nitrogen atoms and 0 to 20 oxygen atoms, a is an integer of 0 or 1.

The present invention also relates to the foregoing lubricating oil composition wherein Component (B) comprises (B2) a poly(meth)acrylate additive (hereinafter may be referred to as "Component (B2)") containing at least a structural unit represented by formula (2):

(2)

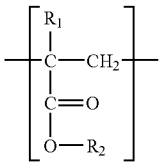

wherein $R_1$ is hydrogen or methyl and $R_2$ is methyl.

EFFECTS OF THE INVENTION

The lubricating oil composition of the present invention is less in evaporation loss even having a low viscosity and excellent in lubricating properties such as low-temperature viscosity characteristics and anti-seizure properties and oxidation stability and is capable of providing gears or bearings of automobile engines, automatic transmissions, manual transmissions, and continuously variable transmissions with sufficient durability and saving energy consumption of automobiles.

BEST MODE OF CARRYING OUT THE INVENTION

The lubricating oil composition of the present invention will be described in detail below.

The lubricating oil composition of the present invention comprises (B) a poly(meth)acrylate additive described below in such an amount that the kinematic viscosity at 100° C. of the composition (Vc) is from 3 to 15 $mm^2/s$, the viscosity index of the composition is from 95 to 200, and the ratio of the kinematic viscosity at 100° C. of (A) a lubricating base oil (Vb) to (Vc) (=Vb/Vc) is 0.60 or greater, and further comprising Components (C) to (E) described below in specific amounts.

The kinematic viscosity at 100° C. of the composition (Vc) is preferably 9 $mm^2/s$ or lower, preferably 4 to 7 $mm^2/s$, more preferably 4.5 to 6.5 $mm^2/s$, more preferably 5 to 6 $mm^2/s$, particularly preferably 5.5 to 6 $mm^2/s$ in view of the balance of anti-seizure properties and low-temperature viscosity characteristics. The viscosity index of the lubricating oil composition is preferably from 100 to 160, more preferably from 120 to 150, more preferably from 130 to 140 in view of the balance of anti-seizure properties, low-temperature viscosity characteristics and the content of Component (B). The ratio of the kinematic viscosity at 100° C. of Component (A) (Vb) to (Vc) (=Vb/Vc) is preferably 0.70 or greater, more preferably 0.75 or greater, more preferably 0.80 or greater, particularly preferably 0.90 or greater and 1.0 or less because anti-seizure properties can be enhanced more when various compositions with the same viscosity are compared.

The evaporation loss, i.e., NOACK evaporation loss of the lubricating oil composition of the present invention is preferably 40 percent by mass or less, more preferably 30 percent by mass or less, more preferably 20 percent by mass or less, more preferably 15 percent by mass or less, particularly preferably 12 percent by mass or less. Further, the NOACK evaporation loss is preferably 5 percent by mass or greater, more preferably 9 percent by mass or greater with the objective of lowering viscosity and in view of the balance of anti-seizure properties and low-temperature viscosity characteristics. The term "NOACK evaporation loss" used herein denotes an evaporation loss measured in accordance with ASTM D 5800-95.

In the present invention, Component (A) is preferably a lubricating base oil having such a kinematic viscosity that the Vb/Vc is 0.60 or greater, specifically a lubricating base oil adjusted in kinematic viscosity at 100° C. to be from 3 to 15 $mm^2/s$. The lubricating base oil may be a mineral base oil, a synthetic base oil or a mixture thereof.

Examples of mineral lubricating base oils which may be used in the present invention include paraffinic or naphthenic oils which can be produced by subjecting a lubricating oil fraction produced by atmospheric- or vacuum-distillation of a crude oil, to any one of or any suitable combination of refining processes selected from solvent deasphalting, solvent extraction, hydrocracking, solvent dewaxing, catalytic dewaxing, hydrorefining, sulfuric acid treatment, and clay treatment; n-paraffins; and iso-paraffins. These base oils may be used alone or in combination at an arbitrary ratio.

Examples of preferred mineral lubricating base oils include the following base oils:

(1) a distillate oil produced by atmospheric distillation of a paraffin base crude oil and/or a mixed base crude oil;

(2) a whole vacuum gas oil (WVGO) produced by vacuum distillation of the topped crude of a paraffin base crude oil and/or a mixed base crude oil;

(3) a wax obtained by a lubricating oil dewaxing process and/or a Fischer-Tropsch wax produced by a GTL process;

(4) an oil obtained by mild-hydrocracking (MHC) one or more oils selected from oils of (1) to (3) above;

(5) a mixed oil of two or more oils selected from (1) to (4) above;

(6) a deasphalted oil (DAO) obtained by deasphalting an oil of (1), (2) (3), (4) or (5);

(7) an oil obtained by mild-hydrocracking (MHC) an oil of (6); and (8) a lubricating oil produced by subjecting a mixed oil of two or more oils selected from (1) to (7) used as a feed stock and/or a lubricating oil fraction recovered therefrom to a normal refining process and further recovering a lubricating oil fraction from the refined product.

There is no particular restriction on the normal refining process used herein. Therefore, there may be used any refining process conventionally used upon production of a lubricating base oil. Examples of the normal refining process include (a) hydro-refining processes such as hydrocracking and hydrofinishing, (b) solvent refining such as furfural extraction, (c) dewaxing such as solvent dewaxing and catalytic dewaxing, (d) clay refining with acidic clay or active clay and (e) chemical (acid or alkali) refining such as sulfuric acid treatment and sodium hydroxide treatment. In the present invention, any one or more of these refining processes may be used in any order.

The mineral lubricating base oil used in the present invention is particularly preferably a base oil produced by further subjecting a base oil selected from (1) to (8) described above to the following treatments.

That is, preferred are a hydrocracked mineral oil and/or wax-isomerized isoparaffin base oil obtained by hydrocracking or wax-isomerizing a base oil selected from (1) to (8) described above as it is or a lubricating fraction recovered therefrom and subjecting the resulting product as it is or a lubricating fraction recovered therefrom to dewaxing such as solvent dewaxing or catalytic dewaxing, followed by solvent refining or followed by solvent refining and then dewaxing such as solvent dewaxing or catalytic dewaxing. The hydrocracked mineral oil and/or wax-isomerized isoparaffin base oil are used in an amount of preferably 30 percent by mass or more, more preferably 50 percent by mass or more, and particularly preferably 70 percent by mass or more, on the basis of the total amount of the base oil.

Examples of synthetic lubricating base oils which may be used in the present invention include poly-α-olefins and hydrogenated compounds thereof; isobutene oligomers and hydrogenated compounds thereof; isoparaffins; alkylbenzenes; alkylnaphthalenes; diesters such as ditridecyl glutarate, di-2-ethylhexyl adipate, diisodecyl adipate, ditridecyl adipate and di-2-ethylhexyl sebacate; polyol esters such as trimethylolpropane caprylate, trimethylolpropane pelargonate, pentaerythritol 2-ethylhexanoate and pentaerythritol pelargonate; polyoxyalkylene glycols; dialkyldiphenyl ethers; and polyphenyl ethers.

Preferred synthetic lubricating base oils are poly-α-olefins. Typical examples of poly-α-olefins include oligomers or cooligomers of α-olefins having 2 to 32, preferably 6 to 16 carbon atoms, such as 1-octene oligomer, 1-decene oligomer, ethylene-propylene cooligomer, and hydrogenated compounds thereof.

There is no particular restriction on the method of producing poly-α-olefins. For example, poly-α-olefins may be produced by polymerizing α-olefins in the presence of a polymerization catalyst such as a Friedel-Crafts catalyst containing aluminum trichloride, boron trifluoride or a complex of boron trifluoride with water, an alcohol such as ethanol, propanol and butanol, a carboxylic acid or an ester such as ethyl acetate and ethyl propionate.

Component (A) used in the present invention may be a mixture of two or more types of mineral base oils or two or more types of synthetic base oils or a mixture of mineral base oils and synthetic base oils. The mix ratio of two or more base oils in such mixtures may be arbitrarily selected.

Component (A) is preferably selected from the following Components (A1) and (A2).

Specifically, Component (A1) is preferably one or more type selected from the following Components (A1a) to (A1c):

(A1a) mineral base oils with a kinematic viscosity at 100° C. of 1.5 $mm^2/s$ or higher and lower than 4.5 $mm^2/s$, preferably from 3.5 to 4.5 $mm^2/s$;

(A1b) mineral base oils with a kinematic viscosity at 100° C. of 4.5 $mm^2/s$ or higher and lower than 7 $mm^2/s$, preferably from 5.3 to 6.5 $mm^2/s$; and (A1c) poly-α-olefin base oils with a kinematic viscosity at 100° C. of 1.5 $mm^2/s$ or higher and lower than 7 $mm^2/s$, preferably from 3.5 to 6.5 $mm^2/s$.

There is no particular restriction on the % $C_A$ Of Components (A1a) to (A1c). However, the % $C_A$ is preferably 3 or less, more preferably 2 or less, particularly preferably 1 or less. Component (A) with a % $C_A$ of 3 or less renders it possible to produce a composition with more excellent oxidation stability. There is no particular restriction on the % $C_p$ of Components (A1a) to (A1c). However, the % $C_p$ is preferably 70 or greater, more preferably 75 or greater, more preferably 78 or greater, and usually 100 or less, preferably 95 or less, more preferably 90 or less. Component (A) with a % $C_A$ within such a range renders it possible to produce a composition with more excellent low-temperature viscosity characteristics and oxidation stability and to enhance the effects of an extreme pressure additive.

The terms "% $C_A$" and "% $C_p$" used herein denote a percentage of aromatic carbon number to total carbon number and paraffin carbon number to total carbon number, respectively, determined by a method prescribed in ASTM D 3238-85.

There is no particular restriction on the viscosity index of Components (A1a) to (A1c). However, the viscosity index is preferably 80 or greater, more preferably 90 or greater, more preferably 110 or greater, more preferably 120 or greater, particularly preferably 130 or greater and usually 200 or less, preferably 160 or less. The use of a lubricating base oil with a viscosity index of 80 or greater renders it possible to produce a composition with excellent viscosity characteristics from low temperatures to high temperatures. The use of a lubricating base oil with a too high viscosity index would deteriorate the low-temperature viscosity characteristics of the resulting lubricating oil composition. In the present invention, Component (A1a) is preferably a lubricating base oil with a viscosity index of 120 or greater while Component (A1b) is preferably a lubricating base oil with a viscosity index of 130 or greater.

There is no particular restriction on the aniline point of Components (A1a) to (A1c). However, the aniline point is preferably 100° C. or higher, more preferably 110° C. or higher, particularly preferably 120° C. or higher and usually 140° C. or lower. The use of a lubricating base oil with an aniline point of 100° C. or higher renders it possible to produce a lubricating oil composition with excellent low-temperature viscosity characteristics and oxidation stability and to enhance the effects of an extreme pressure additive. In the present invention, Component (A1a) is preferably a lubricating base oil with an aniline point of 110° C. or higher while Component (A1b) is preferably a lubricating base oil with an aniline point of 120° C. or higher.

There is no particular restriction on the sulfur content of Components (A1a) to (A1c). However, the sulfur content is preferably 0.05 percent by mass or less, more preferably 0.02 percent by mass or less, particularly preferably 0.005 percent by mass or less. Reduction of the sulfur content of Component (A) renders it possible to produce a composition with more excellent oxidation stability.

Components (A1a) to (A1c) may be used alone or may be arbitrarily mixed. In particular, it is preferable to use (A1a) and (A1b) and/or (A1c) in combination. When (A1a) and/or (A1b) and (A1c) are used in combination, the content of (A1c) is preferably from 1 to 50 percent by mass, more preferably from 3 to 20 percent by mass, more preferably from 3 to 10 percent by mass, on the basis of the total amount of the base oil. In particular, when Component (A1) is used in combination with Component (A2) described below, blend of 3 to 8 percent by mass of Component (A1c) renders it possible to produce effectively at a low cost a lubricating oil composition which can exhibit excellent anti-seizure properties, low temperature characteristics and oxidation stability.

The use of Component (A1) as Component (A) renders it possible to produce a lubricating oil composition with more excellent low-temperature viscosity characteristics and oxidation stability. However, Component (A2) with a kinematic viscosity at 100° C. of 7 to 60 $mm^2/s$ may be used in order to improve lubricating characteristics such as fatigue life. In the case of using Component (A2), it is preferably used in combination with the above-described Component (A1).

Component (A2) is preferably one or more type selected from the following Components (A2a) to (A2c):

(A2a) mineral or synthetic, preferably mineral base oils with a kinematic viscosity at 100° C. of 7 $mm^2/s$ or higher and lower than 15 $mm^2/s$, preferably from 8 to 12 $mm^2/s$;

(A2b) mineral and/or synthetic, preferably mineral base oils with a kinematic viscosity at 100° C. of 15 $mm^2/s$ or greater and less than 25 $mm^2/s$, preferably from 17 to 23 $mm^2/s$; and (A2c) mineral and/or synthetic, preferably mineral base oils with a kinematic viscosity at 100° C. of 25 to 60 $mm^2/s$, preferably from 28 to 40 $mm^2/s$.

The % $C_A$ of Components (A2a) to (A2c) is usually from 0 to 40 and thus is not particularly restricted. However, the % $C_A$ is preferably 2 or greater, more preferably 5 or greater, particularly preferably 7 or greater and preferably 15 or less, more preferably 10 or less because the resulting composition can have both extended fatigue life and excellent oxidation stability.

There is no particular restriction on the viscosity index of Components (A2a) to (A2c). However, the viscosity index is preferably 80 or greater, more preferably 90 or greater, particularly preferably 95 or greater and usually 200 or less, preferably 120 or less, more preferably 110 or less, particularly preferably 100 or less. The use of a lubricating base oil with a viscosity index of 80 or greater renders it possible to produce a composition with excellent viscosity characteristics from low temperatures to high temperatures. The use of a lubricating base oil with a too high viscosity index is less effective to fatigue life.

There is no particular restriction on the sulfur content of Components (A2a) to (A2c). However, the sulfur content is usually from 0 to 2 percent by mass, preferably from 0.05 to 1.5 percent by mass, more preferably 0.3 to 1.2 percent by mass, more preferably 0.5 to 1 percent by mass, particularly preferably 0.7 to 1 percent by mass. The use of Component (A2) with a relatively high sulfur content can enhance fatigue life while the use of Component (A2) with a sulfur content of 1 percent by mass or less renders it possible to produce a composition with more excellent oxidation stability.

When Component (A2) is used in the present invention, it is preferable to use Component (A2b) or (A2c) with the objective of improving fatigue life and particularly preferable to use Component (A2b) with the objective of improving both fatigue life and oxidation stability. The use of Component (A1C) as Component (A1) renders it possible to produce a composition excellent in fatigue life, oxidation stability and low temperature viscosity characteristics.

There is no particular restriction on the content of Components (A1) and (A2) when used in combination. The content of Component (A1) is preferably 50 percent by mass or more, more preferably 70 percent by mass or more, particularly preferably 85 percent by mass or more, on the basis of the total mass of the lubricating base oil. The content of Component (A2) is preferably 50 percent by mass or less, more preferably 30 percent by mass or less, particularly preferably 15 percent by mass or less, on the basis of the total mass of the lubricating base oil. The content of Component (A2) is preferably 3 percent by mass or more, more preferably 5 percent by mass or more with the objective of further improving lubricating characteristics such as extended fatigue life.

As described above, Component (A) used in the present invention is a lubricating base oil composed of Component (A1) or Components (A1) and (A2). The kinematic viscosity at 100° C. of Component (A) is preferably from 3 to 8 $mm^2/s$, more preferably from 4 to 7 $mm^2/s$, more preferably from 4.5 to 6.5 $mm^2/s$, more preferably 5 to 6 $mm^2/s$, particularly preferably from 5.2 to 5.5 $mm^2/s$. The use of a lubricating base oil with a kinematic viscosity at 100° C. of 6 $mm^2/s$ or less renders it possible to produce a lubricating oil composition with a small frictional resistance at lubricating sites because its fluid resistance is small and thus with excellent low temperature viscosity (for example, the Brookfield viscosity at −40° C. is 150,000 Pa·s or less, preferably 50,000 Pa·s or less). The use of a lubricating base oil with a kinematic viscosity at 100° C. of 4.5 $mm^2/s$ or higher renders it possible to produce a lubricating oil composition which is sufficient in oil film formation leading to excellent anti-seizure properties and less in evaporation loss of the base oil under elevated temperature conditions.

There is no particular restriction on the % $C_A$ of Component (A). However, the % $C_A$ is preferably 3 or less, more preferably 2 or less, particularly preferably 1 or less. The use of Component (A) with a % $C_A$ of 3 or less renders it possible to produce a composition with more excellent oxidation stability. There is no particular restriction on the % $C_p$ of Component (A). However, the % $C_p$ is preferably 70 or greater, more preferably 75 or greater, more preferably 78 or greater and is usually 100 or less, preferably 95 or less, more preferably 90 or less. The use of Component (A) with a % $C_p$ within such a range renders it possible to produce a composition with more excellent low-temperature viscosity characteristics and to enhance the effects of an extreme pressure additive.

There is no particular restriction on the viscosity index of Component (A). However, the viscosity index is preferably 80 or greater, more preferably 90 or greater, more preferably 110 or greater, particularly preferably 120 or greater. The use of a lubricating base oil with a viscosity index of 80 or greater renders it possible to produce a composition with excellent viscosity characteristics from low temperatures to high temperatures.

There is no particular restriction on the sulfur content of Component (A). However, the sulfur content is preferably from 0 to 0.3 percent by mass, more preferably 0.1 percent by mass or less, more preferably 0.05 percent by mass or less, particularly preferably 0.005 percent by mass or less. The use of a lubricating base oil with a sulfur content of 0.3 percent by mass or less renders it possible to produce a lubricating oil composition with more excellent oxidation stability.

Component (B) of the lubricating oil composition of the present invention is a poly(meth)acrylate additive, which may be a non-dispersant type poly(meth)acrylate additive having no polar group or a dispersant type poly(meth)acrylate additive having a polar group. However, Component (B) is preferably a non-dispersant type poly(meth)acrylate additive.

Examples of Component (B) include (B1) poly(meth)acrylate additives having a weight-average molecular weight of 30,000 to 1,000,000. The weight-average molecular weight is preferably from 50,000 to 600,000, more preferably from 60,000 to 300,000, more preferably from 80,000 to 250,000, particularly preferably from 200,000 to 230,000.

There is no particular restriction on the ratio (Mw/Mn) of the weight-average molecular weight (Mw) to the number-average molecular weight (Mn) in Component (B1). However, the ratio (Mw/Mn) is preferably from 1.5 to 4, more preferably from 2 to 3.5, particularly preferably from 2.2 to 3.

The weight-average molecular weight and number-average molecular weight used herein denote a weight-average molecular weight and number-average molecular weight in terms of polystyrene determined with a differential refractive index detector (RI) at a temperature of 23° C., a flow rate of 1 mL/min, a sample concentration of 1 percent by mass, and a sample injection amount of 75 μL, using 150-C ALC/GPC manufactured by Waters having two columns GMHHR-M (7.8 mm Id×30 cm) equipped in series therein and tetrahydrofuran as a solvent.

There is no particular restriction on the structure of Component (B1). However, Component (B1) is preferably a poly(meth)acrylate substantially containing only a structural unit represented by formula (1) below:

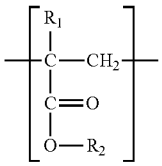

(1)

In formula (1), $R_1$ is hydrogen or methyl, $R_2$ is a hydrocarbon group having 5 to 20 carbon atoms or a group represented by $—(R)_a$-E wherein R is an alkylene group having 5 to 20 carbon atoms, E is an amine moiety or a heterocyclic moiety, each having 1 or 2 nitrogen atoms and 0 to 2 oxygen atoms, and a is an integer of 0 or 1.

Examples of hydrocarbon groups having 5 to 20 carbon atoms for $R_2$ include straight-chain or branched alkyl groups, such as such as pentyl, hexyl, heptyl, octyl, nonyl, decyl, undecyl, dodecyl, tridecyl, tetradecyl, pentadecyl, hexadecyl, heptadecyl, and octadecyl groups; and straight-chain or branched alkenyl groups such as pentenyl, hexenyl, heptenyl, octenyl, noneyl, decenyl, undecenyl, dodecenyl, tridecenyl, tetradecenyl, pentadecenyl, hexadecenyl, heptadecenyl, and octadecenyl groups.

Examples of alkylene groups having 5 to 20 carbon atoms for R include pentylene, hexylene, heptylene, octylene, nonylene, decylene, undecylene, dodecylene, tridecylene, tetradecylene, pentadecylene, hexadecylene, heptadecylene and octadecylene groups, all of which may be straight-chain or branched.

When E is an amine moiety, specific examples thereof include dimethylamino, diethylamino, dipropylamino, dibutylamino, anilino, toluidino, xylidino, acetylamino, and benzoilamino groups. When E is a heterocyclic moiety, specific examples thereof include morpholino, pyrrolyl, pyrrolino, pyridyl, methylpyridyl, pyrrolidinyl, piperidinyl, quinonyl, pyrrolidonyl, pyrrolidono, imidazolino and pyrazino groups.

Component (B1), i.e., the poly(meth)acrylate containing a structural unit represented by formula (1) may be a poly(meth)acrylate produced by polymerizing or copolymerizing one or more types of monomers represented by formula (1'):

$$CH_2{=}C(R_1){-}C({=}O){-}OR_2 \quad (1')$$

wherein $R_1$ and $R_2$ are the same as those in formula (1).

Specific examples of monomers represented by formula (1') include the following monomers (B1a) to (B1c):

(B1a) (meth)acrylates having an alkyl or alkenyl group having 5 to 15 carbon atoms, such as octyl(meth)acrylate, nonyl(meth)acrylate, decyl(meth)acrylate, undecyl(meth)acrylate, dodecyl(meth)acrylate, tridecyl(meth)acrylate, tetradecyl(meth)acrylate, and pentadecyl(meth)acrylate (all of which may be straight-chain or branched), and octenyl(meth)acrylate, noneyl(meth)acrylate, decenyl(meth)acrylate, undecenyl(meth)acrylate, dodecenyl(meth)acrylate, tridecenyl(meth)acrylate, tetradecenyl(meth)acrylate, and pentadecenyl(meth)acrylate (all of which may be straight-chain or branched), preferably (meth)acrylates having a straight-chain alkyl group having 12 to 15 carbon atoms as a main component;

(B1b) (meth)acrylates having an alkyl group having 16 to 20 carbon atoms, preferably a straight-chain alkyl group having 16 to 20 carbon atoms, more preferably a straight-chain alkyl group having 16 or 18 carbon atoms, specifically n-hexadecyl(meth)acrylate, n-octadecyl(meth)acrylate, and n-eicosyl(meth)acrylate; and (B1c) polar group-containing monomers such as amide group-containing vinyl monomers, nitro group-containing monomers, primary to tertiary amino group-containing vinyl monomers, nitrogen-containing heterocyclic vinyl monomers, and hydrochlorides, sulfates, phosphates and lower alkyl($C_1$ to $C_8$) monocarboxylates, of the foregoing monomers, quaternary ammonium base-containing vinyl monomers, amphoteric vinyl monomers containing oxygen and nitrogen, nitrile group-containing monomers, aliphatic hydrocarbon-based vinyl monomers, alicyclic hydrocarbon-based vinyl monomers, aromatic hydrocarbon-based vinyl monomers, vinyl ester, vinyl ether, vinyl ketones, epoxy group-containing vinyl monomers, halogen atom-containing vinyl monomers, esters of unsaturated polycarboxylic acids, hydroxyl group-containing vinyl monomers, polyoxyalkylene chain-containing vinyl monomers, ionic group-containing vinyl monomers containing an anionic, phosphoric acid, sulfonic acid or sulfuric acid ester group, and univalent metal salts, divalent metal salts, amine salts and ammonium salts, of the foregoing monomers, more specifically and preferably nitrogen-containing monomers such as 4-diphenylamine (meth)acrylamide, 2-diphenylamine(meth)acrylamide, dimethylaminoethyl(meth)acryl amide, diethylaminoethyl (meth)acrylamide, dimethylaminopropyl(meth)acrylamide, dimethylaminomethyl methacrylate, diethylaminomethyl methacrylate, dimethylaminoethyl(meth)acrylate, diethylaminoethyl(meth)acrylate, morpholinomethyl methacrylate, morpholinoethyl methacrylate, 2-vinyl-5-methylpyridine and N-vinylpyrrolidone.

In the present invention, Component (B1) is preferably a poly(meth)acrylate which is a copolymer of one or more types of monomers selected from (B1a) monomers and one or more types of monomers selected from (B1b) monomers (if necessary, one or more types of monomers selected from (B1c) monomers may be copolymerized), more preferably a poly(meth)acrylate which is a copolymer of (B1a) a mixture of (meth)acrylates having a straight-chain alkyl group having 12 to 15 carbon atoms and (B1b) a monomer mixture containing a (meth)acrylate having a straight-chain alkyl group having 12 to 15 carbon atoms and a (meth)acrylate having a straight-chain alkyl group having 18 carbon atoms, main components.

The content of Component (B1) in the lubricating oil composition of the present invention is to be such that the kinematic viscosity at 100° C. (Vc) thereof is from 3 to 15 $mm^2/s$, the viscosity index thereof is from 95 to 200, and the above-described Vb/Vc is 0.60 or greater. More specifically, the content is usually from 0.1 to 2 percent by mass, preferably from 0.2 to 1 percent by mass, on the basis of the total mass of the composition.

Desirously, the lubricating oil composition of the present invention contains (B2) a poly(meth)acrylate additive having at least a structural unit represented by formula (2), as Component (B) to an extent that the kinematic viscosity at 100° C.

(Vc) of the composition is from 3 to 15 $mm^2/s$, the viscosity index thereof is from 95 to 200, and the above-described Vb/Vc is 0.60 or greater:

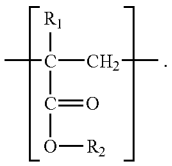

(2)

In formula (2), $R_1$ is hydrogen or methyl and $R_2$ is methyl.

Component (B2), i.e., the poly(meth)acrylate containing a structural unit represented by formula (2) may be a poly (meth)acrylate produced by polymerizing (B2') monomers represented by formula (2') or may be a copolymer of monomers represented by formula (2') and monomers other than those represented by formula (2'):

$$CH_2{=}C(R_1){-}C({=}O){-}OR_2 \quad (2')$$

wherein $R_1$ and $R_2$ are the same as those in formula (2).

Specific examples of monomer (B2') include methyl(meth) acrylates.

Examples of monomers other than monomers (B2') represented by formula (2') include the following (B2a) to (B2e) monomers:

(B2a) (meth)acrylates having an alkyl group having 2 to 4 carbon atoms, such as ethyl(meth)acrylate, n- or i-propyl (meth)acrylate, and n-, i- or sec-butyl(meth)acrylate;

(B2b) (meth)acrylates having an alkyl or alkenyl group having 5 to 15 carbon atoms, such as octyl(meth)acrylate, nonyl(meth)acrylate, decyl(meth)acrylate, undecyl(meth) acrylate, dodecyl(meth)acrylate, tridecyl(meth)acrylate, tetradecyl(meth)acrylate, and pentadecyl(meth)acrylate (all of which may be straight-chain or branched), and octenyl(meth) acrylate, noneyl(meth)acrylate, decenyl(meth)acrylate, undecenyl(meth)acrylate, dodecenyl(meth)acrylate, tridecenyl(meth)acrylate, tetradecenyl(meth)acrylate, and pentadecenyl(meth)acrylate (all of which may be straight-chain or branched), preferably (meth)acrylates having a straight-chain alkyl group having 12 to 15 carbon atoms as a main component;

(B2c) (meth)acrylates having an alkyl or alkenyl group having 16 to 30 carbon atoms, preferably a straight-chain alkyl group having 16 to 20 carbon atoms, more preferably a straight-chain alkyl group having 16 or 18 carbon atoms, specifically n-hexadecyl(meth)acrylate, n-octadecyl(meth) acrylate, n-eicosyl(meth)acrylate, n-docosyl(meth)acrylate, n-tetracosyl(meth)acrylate, n-hexacosyl(meth)acrylate, and n-octacosyl(meth)acrylate, and particularly preferably n-hexadecyl(meth)acrylate and n-octadecyl(meth)acrylate;

(B2d) (meth)acrylates having a branched alkyl or alkenyl group having 16 to 30 carbon atoms, preferably a branched alkyl group having 20 to 28 carbon atoms, more preferably a branched alkyl group having 22 to 26 carbon atoms, specifically branched hexadecyl(meth)acrylate, branched octadecyl (meth)acrylate, branched eicosyl(meth)acrylate, branched docosyl(meth)acrylate, branched tetracosyl(meth)acrylate, branched hexacosyl(meth)acrylate, and branched octacosyl (meth)acrylate, preferably (meth)acrylate having a branched alkyl group having 16 to 30 carbon atoms, preferably 20 to 28 carbon atoms, more preferably 22 to 26 carbon atoms, as represented by —C—$C(R_3)R_4$ wherein there is no particular restriction on $R_3$ or $R_4$ as long as the carbon number of $R_2$ is from 16 to 30, but $R_3$ is a straight-chain alkyl group having preferably 6 to 12, more preferably 10 to 12 carbon atoms, and $R_4$ is a straight-chain alkyl group having preferably 10 to 16 carbon atoms, more preferably 14 to 16 carbon atoms, more specifically (meth)acrylates having a branched alkyl group having 20 to 30 carbon atoms, such as 2-decyl-tetradecyl(meth)acrylate, 2-dodecyl-hexadecyl(meth)acrylate, and 2-decyl-tetradecyloxyethyl(meth)acrylate;

(B2e) polar group-containing monomers such as amide group-containing vinyl monomers, nitro group-containing monomers, primary to tertiary amino group-containing vinyl monomers, nitrogen-containing heterocyclic vinyl monomers, and hydrochlorides, sulfates, phosphates and lower alkyl($C_1$ to $C_8$) monocarboxylates, of the foregoing monomers, quaternary ammonium base-containing vinyl monomers, amphoteric vinyl monomers containing oxygen and nitrogen, nitrile group-containing monomers, aliphatic hydrocarbon-based vinyl monomers, alicyclic hydrocarbon-based vinyl monomers, aromatic hydrocarbon-based vinyl monomers, vinyl ester, vinyl ether, vinyl ketones, epoxy group-containing vinyl monomers, halogen atom-containing vinyl monomers, esters of unsaturated polycarboxylic acids, hydroxyl group-containing vinyl monomers, polyoxyalkylene chain-containing vinyl monomers, ionic group-containing vinyl monomers containing an anionic, phosphoric acid, sulfonic acid or sulfuric acid ester group, and univalent metal salts, divalent metal salts, amine salts and ammonium salts, of the foregoing monomers, more specifically and preferably nitrogen-containing monomers such as 4-diphenylamine (meth)acrylamide, 2-diphenylamine(meth)acrylamide, dimethylaminoethyl(meth)acryl amide, diethylaminoethyl (meth)acrylamide, dimethylaminopropyl(meth)acrylamide, dimethylaminomethyl methacrylate, diethylaminomethyl methacrylate, dimethylaminoethyl(meth)acrylate, diethylaminoethyl(meth)acrylate, morpholinomethyl methacrylate, morpholinoethyl methacrylate, 2-vinyl-5-methylpyridine and N-vinylpyrrolidone.

Component (B2) used in the present invention is a poly (meth)acrylate compound produced by polymerizing the above-described (B2') or copolymerizing the above-described (B2') and one or more types of monomers selected from the above-described (B2a) to (B2e), and more preferable specific examples of the compound include the following compounds:

(1) non-dispersant type poly(meth)acrylates, which are copolymers of (B2') and (B2b), or hydrogenated compounds thereof;

(2) non-dispersant type poly(meth)acrylates, which are copolymers of (B2'), (B2b) and (B2c), or hydrogenated compounds thereof;

(3) non-dispersant type poly(meth)acrylates, which are copolymers of (B2'), (B2b), (B2c) and (B2d), or hydrogenated compounds thereof;

(4) dispersant type poly(meth)acrylates, which are copolymers of (B2'), (B2b) and (B2e), or hydrogenated compounds thereof;

(5) dispersant type poly(meth)acrylates, which are copolymers of (B2'), (B2b), (B2c) and (B2e), or hydrogenated compounds thereof; and (6) dispersant type poly(meth)acrylates, which are copolymers of (B2'), (B2b), (B2c), (B2d) and (B2e), or hydrogenated compounds thereof. More preferred are non-dispersant type poly(meth)acrylate compounds (1) to (3), more preferred are non-dispersant type poly(meth)acrylate compounds (2) or (3), and particularly preferred are non-dispersant type poly(meth)acrylate compounds (3).

When the composition ratio of the structural unit represented by formula (2) is defined by molar ratio on the basis of the total mass of the monomers constituting a poly(meth) acrylate, it is 5 percent by mole or more, preferably 15 percent by mole or more, particularly preferably 30 percent by mole or more and in view of low temperature viscosity characteristics is preferably 80 percent by mole or less, more preferably 60 percent by mole or less, particularly preferably 50 percent by mole or less.

There is no particular restriction on the weight-average molecular weight of Component (B2), which is usually from 5,000 to 1,000,000. However, it is preferably 500,000 or less, more preferably 300,000 or less, more preferably 150,000 or less with the objective of obtaining excellent shear stability and retaining the initial extreme pressure properties at ease and is preferably from 10,000 to 60,000, more preferably from 15,000 to 30,000, particularly preferably from 15,000 to 24,000 with the objective of obtaining more excellent low temperature viscosity characteristics and improving fatigue life. Further, it is preferably from 100,000 to 600,000, more preferably from 150,000 to 550,000, more preferably from 300,000 to 500,000 with the objective of obtaining excellent low temperature viscosity characteristics and enhancing viscosity index.

The weight-average molecular weight used herein denotes a weight-average molecular weight in terms of polystyrene determined with a differential refractive index detector (RI) at a temperature of 23° C., a flow rate of 1 mL/min, a sample concentration of 1 percent by mass, and a sample injection amount of 75 μL, using 150-C ALC/GPC manufactured by Waters having two columns GMHHR-M (7.8 mm Id×30 cm) equipped in series therein and tetrahydrofuran as a solvent.

When Component (B2) is blended in the lubricating oil composition of the present invention, the content is to be such that the kinematic viscosity at 100° C. of the composition (Vc) is from 3 to 15 $mm^2/s$, the viscosity index of the composition is from 95 to 200, and the above-described Vb/Vc is 0.60 or greater. More specifically, content of Component (B2) including the amount of a diluent is usually from 0.1 to 5 percent by mass, preferably from 0.5 to 2 percent by mass, particularly preferably from 0.8 to 1.5 percent by mass on the basis of the total mass of the composition. The content of Component (B2) within the above range renders it possible to produce a composition with more excellent low-temperature viscosity characteristics. The content of Component (B2) in excess of the above range is not preferable because the resulting composition would not only fail to achieve effects as balanced with the content but also is poor in shear stability and unlikely to retain the initial extreme pressure properties for a long period of time. In the present invention, Component (B) may be composed of Component (B1) or Component (B2) alone. However, the use of Components (B1) and (B2) in combination is preferable because low temperature viscosity characteristics can be further improved.

The lubricating oil composition of the present invention is necessarily blended with various additives such as (C) metallic detergents, (D) ashless dispersants and (E) zinc dithiophosphates, each in a specific amount in order to improve lubricating properties such as anti-seizure properties and oxidation stability although the composition has a low viscosity.

There is no particular restriction on Component (C). Examples of Component (C) include conventional alkali metal or alkaline earth metal sulfonates, alkali metal or alkaline earth metal phenates, alkali metal or alkaline earth metal salicylates, alkali metal or alkaline earth metal naphthenates, alkali metal or alkaline phosphonates, mixtures of two or more types of these detergents (including complex types). However, particularly preferred are alkaline earth metal sulfonates with the objective of further enhancing anti-seizure properties.

Examples of the alkali metal include sodium and potassium. Examples of the alkaline earth metal include calcium, magnesium and barium. Preferred are alkaline earth metals, and particularly preferred are calcium and magnesium. The total base number and content of these metallic detergents may be arbitrarily selected depending on the properties of the lubricating oil to be required.

The above-described metallic detergents include not only neutral metallic detergents but also (over) basic metallic detergents. However, in the present invention, preferred are (over) basic metallic detergents containing calcium carbonate and/or calcium borate.

There is no particular restriction on the base number of the metallic detergents. However, the base number is preferably from 0.0 to 500 mgKOH/g, more preferably from 150 to 450 mgKOH/g, particularly preferably from 200 to 400 mgKOH/g. The term "base number" used herein denotes a base number measured by the perchloric acid potentiometric titration method in accordance with section 7 of JIS K2501 "Petroleum products and lubricants-Determination of neutralization number" (hereinafter the same).

The content of Component (C) in the lubricating oil composition of the present invention is from 0.03 to 0.5 percent by mass, preferably from 0.08 to 0.3 percent by mass, particularly preferably from 0.1 to 0.25 percent by mass in terms of metal on the basis of the total mass of the composition. When the content of Component (C) is less than 0.03 percent by mass in terms of metal, the resulting composition would be poor in anti-seizure properties and fail to enhance oxidation stability sufficiently. When the content is in excess of 0.05 percent by mass, effects as balanced with the content would not be attained.

Component (D) used in the present invention is an ashless dispersant.

The ashless dispersant may be any compound that has been used as an ashless dispersant for lubricating oils. Examples of such an ashless dispersant include nitrogen-containing compounds such as succinimides, benzylamines and polyamines, each having per molecule at least one alkyl or alkenyl group having 40 to 400 carbon atoms, and derivatives thereof.

The alkyl or alkenyl group may be straight-chain or branched and is preferably a branched alkyl or alkenyl group derived from an oligomer of an olefin such as propylene, 1-butene, or isobutylene, or a cooligomer of ethylene and propylene.

The carbon number of the alkyl or alkenyl group is from 40 to 400, preferably from 60 to 350. The alkyl or alkenyl group of fewer than 40 carbon atoms would cause the poor dissolubility of the compound in the lubricating base oil while the alkyl or alkenyl group of more than 400 carbon atoms would degrade the low-temperature fluidity of the resulting lubricating oil composition.

Specific examples of derivatives of nitrogen-containing compounds exemplified as an example of ashless dispersants include an acid-modified compound produced by allowing any of the above-described nitrogen-containing compounds to react with a monocarboxylic acid (fatty acids or the like) having 2 to 30 carbon atoms or a polycarboxylic acid having 2 to 30 carbon atoms, such as oxalic acid, phthalic acid, trimellitic acid, and pyromellitic acid, so as to neutralize or amidize the whole or part of the remaining amino and/or imino groups; a boron-modified compound produced by allowing any of the above-described nitrogen-containing compounds to react with boric acid, so as to neutralize or amidize the whole or part of the remaining amino and/or imino groups; a sulfur-modified compound produced by allowing any of the above-described nitrogen-containing compounds to react with a sulfuric compound; and modified products produced by a combination of two or more selected from the modifications with acid, boron and sulfur, of the above-described nitrogen-containing compounds.

Component (D) may be any one or more types of compounds selected from the above-described compounds.

In the present invention, it is preferable to use a mono type succinimide ashless dispersant, a bis type succinimide ashless dispersant, or a mixture thereof. A bis type succinimide ashless dispersant is desirously blended as an essential component with the objective of further enhancing anti-seizure properties and oxidation stability.

The content of Component (D) in the lubricating oil composition of the present invention is from 0.005 to 0.15 percent by mass, preferably from 0.01 to 0.1 percent by mass, more preferably from 0.02 to 0.04 percent by mass in terms of nitrogen on the basis of the total mass of the composition. When the content of Component (D) is less than 0.005 percent by mass, sufficient anti-seizure properties would not be attained. When the content is in excess of 0.15 percent by mass, effects as balanced with the content would not be attained.

Component (E) used in the present invention is zinc dithiophosphate.

Examples of zinc dithiophosphate include compounds represented by formula (3):

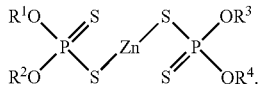

(3)

In formula (3), $R^1$ to $R^4$ may be the same or different from each other and are each independently an alkyl group having 3 to 24, preferably 3 to 8 carbon atoms. The alkyl group may be a primary, secondary or tertiary alkyl group. Preferred are primary and/or secondary alkyl groups. More preferred are primary alkyl groups because of their excellent oxidation stability. Particularly preferred are secondary alkyl groups because of their excellent anti-seizure properties.

The content of Component (E) in the lubricating oil composition of the present invention is from 0.02 to 0.3 percent by mass, preferably from 0.04 to 0.2 percent by mass, more preferably from 0.12 to 0.18 percent by mass in terms of phosphorus on the basis of the total mass of the composition. When the content of Component (E) is less than 0.02 percent by mass, anti-seizure properties would be insufficient. When the content is in excess of 0.3 percent by mass, effects as balanced with the content would not be attained and the resulting composition would be poor in oxidation stability.

When the lubricating oil composition of the present invention is used for manual transmissions in which lubricating conditions for gears are particularly severe, the content of the composition is preferably 0.12 percent by mass or more, more preferably from 0.13 to 0.18 percent by mass in terms of phosphorus, on the basis of the total mass of the composition. Alternatively, when the lubricating oil composition is used as an engine oil, the content is preferably 0.12 percent by mass or less, more preferably 0.1 percent by mass or less, more preferably 0.08 percent by mass or less, particularly preferably 0.05 percent by mass or less in terms of phosphorus in order to avoid harmful effects to an exhaust gas purifying system as much as possible.

The lubricating oil composition of the present invention may be blended with various additives such as extreme pressure additives, viscosity index improvers, cold flow improvers, friction modifiers, anti-oxidants, corrosion inhibitors, rust inhibitors, demulsifiers, metal deactivators, pour point depressants, seal swelling agents, anti-foaming agents, and dyes, alone or in combination in order to further enhance the properties of the composition or impart the composition with properties required for various lubricating oils.

Examples of extreme pressure additives include at least one type of phosphorus extreme pressure additive selected from phosphorous acid, phosphorus acid monoesters, phosphorus acid diesters, phosphorus acid triesters, phosphoric acid, phosphoric acid monoesters, phosphoric acid diesters, phosphoric acid triesters, and salts thereof; at least one type of sulfur extreme pressure additive selected from sulfurized fats and oils, sulfurized olefins, (dihydrocarbyl)polysulfides, dithiocarbamates, thiaziazoles, and benzothiazoles; and at least one type of phosphorus-sulfur extreme pressure additive selected from thiophosphorus acids, thiophosphorus acid monoesters, thiophosphorus acid diesters, thiophosphorus acid triesters, dithiophosphorus acid, dithiophosphorus acid monoesters, dithiophosphorus acid diesters, dithiophosphorus acid triesters, trithiophosphorus acid, trithiophosphorus acid monoesters, trithiophosphorus acid diesters, trithiophosphorus acid triesters, thiophosphoric acids, thiophosphoric acid monoesters, thiophosphoric acid diesters, thiophosphoric acid triesters, dithiophosphoric acid, dithiophosphoric acid monoesters, dithiophosphoric acid diesters, dithiophosphoric acid triesters, trithiophosphoric acid, trithiophosphoric acid monoesters, trithiophosphoric acid diesters, triphosphoric acid triesters, and salts or derivatives thereof.

One or more types selected from the above-mentioned phosphorus extreme pressure additives, sulfur extreme pressure additives, and phosphorus-sulfur extreme pressure additives may be blended with the lubricating oil composition of the present invention. With the objective of significantly improve the durability of engines and gears of transmissions, in particular against friction or pitching on gears of manual transmissions, it is preferable to use phosphorus extreme pressure additives and/or sulfur extreme pressure additives and it is particularly preferable to use phosphorus extreme pressure additives and sulfur extreme pressure additives in combination. The phosphorus extreme pressure additives are preferably phosphorous acid esters. The sulfur extreme pressure additives are preferably those containing sulfur in an amount of usually 2 to 60 percent by mass, preferably 5 to 50 percent by mass, particularly preferably sulfurized fats and oils and polysulfides.

When an extreme pressure additive is contained in the lubricating oil composition of the present invention, there is no particular restriction on the content of the extreme pressure additive. However, the content is usually from 0.005 to 0.2 percent by mass, preferably from 0.01 to 0.05 percent by mass in terms of phosphorus and/or is from 0.01 to 2 percent by mass, preferably from 0.1 to 1 percent by mass, particularly preferably from 0.2 to 0.5 percent by mass in terms of sulfur. When the content is less than 0.005 percent by mass in terms of phosphorus or less than 0.01 percent by mass in terms of sulfur, the extreme pressure additive would be less effective in improving the durability of gears. When the content is in excess of 0.2 percent by mass in terms of phosphorus or in excess of 2 percent by mass, effects as balanced with the content would not be attained and oxidation stability would be deteriorated.

The viscosity index improvers may be those other than Component (B). More specifically, the lubricating oil composition may be blended with one or more types selected from non-dispersant or dispersant type ethylene-α-olefin copolymers and hydrogenated compounds thereof, polyisobutylenes or hydrogenated compounds thereof, styrene-diene hydrogenated copolymers, styrene-maleic anhydride ester copolymers, and polyalkylstyrenes. When these viscosity index improvers are blended, there is no particular restriction on the content thereof. However, the content is usually from 0.01 to 10 percent by mass on the basis of the total mass of the composition. When these viscosity index improvers are blended, the content thereof is not influenced with the requirements concerning the above-described VC and Vb/Vc ratio. However, the content is desirously to be such that the VC and Vb/Vc ratio satisfy the requirements with the objective of improving fuel consumption resulting from the lowered viscosity of the composition.

Examples of cold flow improvers include conventional cold flow improvers having properties to modify the crystal structure of wax precipitating at 10° C. or lower. More specific examples include (co)polymers of monomers containing unsaturated esters; carboxylic acid esters of polyalkylene glycol; hydrocarbyl amines; reactions products of hydrocarbyl amines and carboxylic acid; phenol resins; and mixtures thereof.

When cold flow improvers are added, the content thereof is preferably from 0.005 to 0.5 percent by mass, more preferably from 0.01 to 0.2 percent by mass, particularly preferably from 0.02 to 0.15 percent by mass on the basis of the total mass of the composition. Commercially available products referred to as "cold flow improvers" are in the form wherein effective components contributing to low temperature fluidity are diluted with an adequate solvent for the purposes of improving handling characteristics or oil solubility. When such products are added to the lubricating oil composition, the foregoing content denotes the content including the amount of the solvent.

The friction modifiers may be any compounds that have been generally used as friction modifiers for lubricating oils. Specific examples include amine compounds, imide compounds, fatty acid esters, fatty acid amides, and fatty acid metal salts, each having per molecule at least one alkyl or alkenyl group having 6 to 30 carbon atoms, particularly a straight-chain alkyl or alkenyl group having 6 to 30 carbon atoms.

The lubricating oil composition of the present invention may be blended with any one or more types selected from the foregoing friction modifiers in any amount. However, the content is from 0.01 to 5.0 percent by mass, preferably from 0.03 to 3.0 percent by mass on the basis of the total mass of the composition.

The anti-oxidants may be any anti-oxidants that have been usually used in lubricating oils, such as phenolic or aminic compounds.

Specific examples of the anti-oxidant include alkylphenols such as 2-6-di-tert-butyl-4-methylphenol; bisphenols such as methylene-4,4-bisphenol(2,6-di-tert-butyl-4-methylphenol); naphthylamines such as phenyl-α-naphthylamine; dialkyldiphenylamines; zinc dialkyldithiophosphoric acids such as di-2-ethylhexyldithiophosphoric acid; and esters of (3,5-di-tert-butyl-4-hydroxyphenyl) fatty acid (propionic acid) or (3-methyl-5-tert-butyl-4-hydroxyphenyl) fatty acid (propionic acid) with a monohydric or polyhydric alcohol such as methanol, octanol, octadecanol, 1,6-hexanediol, neopentyl glycol, thiodiethylene glycol, triethylene glycol and pentaerythritol.

The lubricating oil composition of the present invention may be blended with any one or more types selected from the foregoing anti-oxidants in any amount. However, the content is from 0.01 to 5 percent by mass, preferably from 0.1 to 3 percent by mass on the basis of the total mass of the composition.

Examples of the corrosion inhibitors include benzotriazole-, tolyltriazole-, thiadiazole- and imidazole-type compounds.

Examples of the rust inhibitors include petroleum sulfonates, alkylbenzene sulfonates, dinonylnaphthalene sulfonates, alkenyl succinic acid esters and polyhydric alcohol esters.

Examples of demulsifiers include polyalkylene glycol-based non-ionic surfactants such as polyoxyethylenealkyl ethers, polyoxyethylenealkylphenyl ethers, and polyoxyethylenealkylnaphthyl ethers.

Examples of metal deactivators include imidazolines, pyrimidine derivatives, alkylthiadiazoles, mercaptobenzothiazoles, benzotriazoles and derivatives thereof, 1,3,4-thiadiazolepolysulfide, 1,3,4-thiadiazolyl-2,5-bisdialkyldithiocarbamate, 2-(alkyldithio)benzoimidazole, and β-(o-carboxybenzylthio)propionitrile.

The anti-foaming agents may be any compounds that have been usually used as anti-foaming agents for lubricating oils. Examples of such anti-foaming agents include silicones such as dimethylsilicone and fluorosilicone. One or more compounds selected from these compounds may be blended in any amount.

The seal swelling agents may be any compounds that have been usually used as seal swelling agents for lubricating oils. Examples of such seal swelling agents include ester-, sulfur- and aromatic-based seal swelling agents.

The dyes may be any compounds that have been usually used and may be blended in any amount. However, the content is usually from 0.001 to 1.0 percent by mass on the basis of the total mass of the composition.

When these additives are blended with the lubricating oil composition of the present invention, the content of each of the corrosion inhibitors, rust inhibitors and demulsifiers is from 0.005 to 5 percent by mass, the content of each of the pour point depressants and metal deactivators is from 0.005 to 2 percent by mass, the content of seal swelling agents is from 0.01 to 5 percent by mass, and the content of the anti-foaming agents is from 0.0005 to 1 percent by mass, all on the basis of the total mass of the composition.

Since the lubricating oil composition of the present invention has the above-described component structure, it is less in evaporation loss and is so improved in anti-seizure properties, extreme pressure properties and fatigue life that it is capable of providing gears or bearings with sufficient durability and excellent in low-temperature viscosity characteristics and oxidation stability. However, in order to enhance the fuel saving properties of the composition by reducing frictional loss by agitation, compared with conventional lubricating oils for engines, automatic transmissions, continuously variable transmissions and manual transmissions, the composition is desirously to be such that the kinematic viscosity at 100° C. is 15 $mm^2/s$ or lower, preferably 9 $mm^2/s$ or lower, more preferably 7 $mm^2/s$ or lower, more preferably 6.5 $mm^2/s$ or lower, particularly preferably 6 $mm^2/s$ or lower and such that the kinematic viscosity at 40° C. is preferably 150 $mm^2/s$ or lower, more preferably 50 $mm^2/s$ or lower, more preferably 35 $mm^2/s$ or lower, particularly preferably 32 $mm^2/s$ or lower.

Further, in order to enhance the extreme pressure properties of the composition when used for engines, automatic transmissions, continuously variable transmissions and manual transmissions, the composition is desirously to be such that the kinematic viscosity at 100° C. is 3 $mm^2/s$ or greater, preferably 4 $mm^2/s$ or greater, more preferably 4.5 $mm^2/s$ or greater, more preferably 5 $mm^2/s$ or greater, particularly preferably 5.5 $mm^2/s$ or greater and such that the kinematic viscosity at 40° C. is preferably 20 $mm^2/s$ or greater, more preferably 25 $mm^2/s$ or greater.

APPLICABILITY IN THE INDUSTRY

The lubricating oil composition of the present invention is less in evaporation loss even though lowered in viscosity and is so improved in anti-seizure properties, extreme pressure properties and fatigue life that it is capable of providing gears or bearings with sufficient durability and excellent in low-temperature viscosity characteristics and oxidation stability. Further, since the composition is excellent in low-temperature viscosity characteristics and oxidation stability and can reduce frictional loss by agitation caused by lubricating oil, the composition can contribute to fuel saving when used in engines, automobile transmissions, in particular automatic transmissions, continuously variable transmissions or manual transmissions or automobile final reduction gear units.

EXAMPLES

Hereinafter, the present invention will be described in more details by way of the following examples and comparative examples, which should not be construed as limiting the scope of the invention.

Examples 1 to 4 and Comparative Examples 1 to 5

In accordance with the formulations set forth in Table 1, lubricating oil compositions according to the present invention (Examples 1 to 4) were prepared. These compositions were subjected to the following evaluation tests and the results thereof are also set forth in Table 1.

Lubricating oil composition for comparison (Comparative Examples 1 to 5) were also prepared in accordance with the formulations set forth in Table 1. These compositions were also subjected to the same evaluation tests and the results thereof are also set forth in Table 1.

(1) Measurement of Low Temperature Viscosity (BF Viscosity (−40° C.))

The low temperature viscosity at −40° C. of each composition was measured in accordance with ASTM D2983. In the present invention, the viscosity is preferably 150,000 Pa·s or lower, more preferably 50,000 Pa·s or lower.

(2) Falex Pin Vee Block Seizure Load (lb)

The anti-seizure properties of each composition were evaluated in accordance with Seizure Load Procedure B of ASTM D3233. In the present invention, the seizure load is preferably 1,000 lb or greater.

(3) Oxidation Stability Test

This test was carried out in accordance with the method (ISOT) of Section 4 of JIS K 2514. The oxidation stability was evaluated with the increase of total acid number between prior to and after the test. In the present invention, the increase of acid number is preferably 0.7 mgOH/g or less.

As set forth in Table 1, it is confirmed that the lubricating oil compositions of the present invention (Examples 1 to 4) each having a ratio of the kinematic viscosity at 100° C. of (A) the lubricating base oil (Vb) to the kinematic viscosity at 100° C. of the composition (Vc), i.e., (Vb/Vc) is 0.60 or greater and containing Components (B) to (E) in specific amounts were excellent in low evaporation properties, anti-seizure properties, low-temperature viscosity characteristics and oxidation stability even though they were low in viscosity.

On the other hand, it is confirmed that the composition containing no Component (B) (Comparative Example 1), the composition containing Component (B) but having a Vb/Vc of less than 0.60 (Comparative Example 2) and the compositions not containing any of Components (C) to (E) in a predetermined amount (Comparative Examples 3 to 5) were poor in any of the foregoing properties.

TABLE 1

| | | Example 1 | Example 2 | Example 3 | Example 4 | Comparative Example 1 | Comparative Example 2 | Comparative Example 3 | Comparative Example 4 | Comparative Example 5 |
|---|---|---|---|---|---|---|---|---|---|---|
| Base oil (on the basis of the total mass of base oil) | | | | | | | | | | |
| (A1a) base oil A[1)] | mass % | | | | | | 83 | | | |
| (A1b) base oil B[2)] | mass % | 33 | 53 | 60 | 33 | 33 | 17 | 33 | 33 | 33 |
| (A1b) base oil C[3)] | mass % | 67 | 47 | 35 | 67 | 67 | | 67 | 67 | 67 |
| (A2b) base oil D[4)] | mass % | | | 5 | | | | | | |
| Base oil characteristics | | | | | | | | | | |
| Kinematic Viscosity (100° C.): Vb | $mm^2/s$ | 5.4 | 5 | 5 | 5.4 | 5.4 | 3.0 | 5.4 | 5.4 | 5.4 |
| Additives (on the basis of the total mass of composition) | | | | | | | | | | |
| (B1) PMA-A[5)] | mass % | 0.3 | 0.3 | 0.3 | 0.3 | — | 0.3 | 0.3 | 0.3 | 0.3 |
| (B2) PMA-B[6)] | mass % | | 1 | 1 | | | | | | |
| (B3) PMA-C[7)] | mass % | | | | | | 3.1 | | | |
| (C) Overbased Ca sulfonate[8)] (Ca content) | mass % | 0.15 | 0.15 | 0.15 | 0.15 | 0.15 | 0.15 | 0.02 | 0.15 | 0.15 |
| (D) Alkenylsuccinimide[9)] (N content) | mass % | 0.03 | 0.03 | 0.03 | 0.03 | 0.03 | 0.03 | 0.03 | — | 0.03 |
| (E1) ZnDTP-A[10)] (P content) | mass % | 0.15 | 0.15 | 0.15 | | 0.15 | 0.15 | 0.15 | 0.15 | 0.01 |

TABLE 1-continued

| | | Example 1 | Example 2 | Example 3 | Example 4 | Comparative Example 1 | Comparative Example 2 | Comparative Example 3 | Comparative Example 4 | Comparative Example 5 |
|---|---|---|---|---|---|---|---|---|---|---|
| (E2) ZnDTP-B[11] (P content) | mass % | | | | 0.15 | | | | | |
| Phosphorus acid ester[12] (P content) | mass % | 0.02 | 0.02 | 0.02 | 0.02 | 0.02 | 0.02 | 0.02 | 0.02 | 0.02 |
| Sulfurized fats and oils[13] | mass % | 1.0 | 1.0 | 1.0 | 1.0 | 1.0 | 1.0 | 1.0 | 1.0 | 1.0 |
| Polysulfide[14] | mass % | 0.5 | 0.5 | 0.5 | 0.5 | 0.5 | 0.5 | 0.5 | 0.5 | 0.5 |
| Composition characteristics · Test results | | | | | | | | | | |
| Kinematic viscosity (100° C.): Vc | $mm^2/s$ | 5.7 | 5.7 | 5.7 | 5.7 | 5.7 | 5.7 | 5.7 | 5.7 | 5.7 |
| Vb/Vc | | 0.95 | 0.88 | 0.88 | 0.95 | 0.95 | 0.53 | 0.95 | 0.95 | 0.95 |
| Viscosity Index | | 123 | 135 | 132 | 123 | 122 | 171 | 123 | 123 | 123 |
| NOACK evaporation loss (250° C., 1 h) | mass % | 8.6 | 10.0 | 10.4 | 8.6 | 8.6 | 40.9 | 8.5 | 8.5 | 8.5 |
| Low temperature viscosity (BF method: −40° C.) | mPa · s | 39000 | 30000 | 53000 | 40000 | >100000 | 16800 | 38000 | 37000 | 39000 |
| Extreme pressure properties (FALEX Pin Vee Block) | Seizure load procedure (B), lb | 1520 | 1520 | 1520 | 1290 | — | 770 | 850 | 1040 | 850 |
| Oxidation stability (ISOT150° C. × 96 h) acid number increase | mgKOH/g | 0.55 | 0.58 | 0.67 | 0.52 | — | 0.55 | 0.78 | 1.05 | — |

[1]Hydrocracked mineral oil (100° C. kinematic viscosity: 2.6 $mm^2/s$, aniline point: 104° C., % $C_p$: 75, % $C_A$: 0, pour point: −27.5° C., sulfur content: <0.001mass %, viscosity index: 110)
[2]Hydrocracked mineral oil (100° C. kinematic viscosity: 4.2 $mm^2/s$, aniline point: 116° C., % $C_p$: 81, % $C_A$: 0, pour point: −17.5° C., sulfur content: <0.001mass %, viscosity index: 123)
[3]Hydrocracked mineral oil (100° C. kinematic viscosity: 6.2 $mm^2/s$, aniline point: 123° C., % $C_p$: 81, % $C_A$: 0, pour point: −12.5° C., sulfur content: <0.001mass %, viscosity index: 133)
[4]Solvent-refined mineral oil (100° C. kinematic viscosity: 21.9 $mm^2/s$, % $C_A$: 7, sulfur content: 0.91mass %, viscosity index: 95)
[5]Non-disparsant type polymethacrylate additive derived from polymer of mixture containing nC12MA, nC13MA, nC14MA, nC15MA, nC16MA, nC18MA, as main components (Mw: 217,000, Mw/Mn = 2.85) (MA: methacrylate)
[6]Non-disparsant type polymethacrylate additive derived from polymer of mixture containing methyl MA, nC12MA, nC13MA, nC14MA, nC15MA, nC16MA, nC18MA, 2-decyltetradecyl MA, as main components (Mw: 22,900) (MA: methacrylate)
[7]Non-disparsant type polymethacrylate additive derived from polymer of mixture containing methyl MA, nC12MA, nC13MA, nC14MA, nC15MA, as main components (Mw: 100,000) (MA: methacrylate)
[8]Calcium sulfonate (base number: 300 mgKOH/g, Ca content: 12mass %)
[9]Polybutenyl succinimide ashless dispersent (bis type, number-average molecular weight of polybutenyl group: 1500, nitrogen content: 1.3mass %)
[10]Zinc dialkyldithiophosphate (alkyl: secontary alkyl, carbon number: 3 and 6, Zinc content: 11.2 mass %)
[11]Zinc dialkyldithiophosphate (alkyl: primary alkyl, carbon number: 8, Zinc content: 7.9 mass %)
[12]Alkylphosphite (phosphorus content: 6 mass %)
[13]Sulfurized fats and oils (sulfur content: 10 mass %)
[14]Dihydrocarbyl polysulfide (sulfur content: 40 mass %)

The invention claimed is:

1. A lubricating oil composition comprising (A) a lubricating base oil and (B) a poly(meth)acrylate additive in such an amount that the kinematic viscosity at 100° C. of the composition (Vc) is from 3 to 15 $mm^2/s$, the viscosity index of the composition is from 95 to 200, and the ratio of the kinematic viscosity at 100° C. of (A) the lubricating base oil (Vb) to (Vc) (=Vb/Vc) is 0.60 or greater, further, on the basis of the total mass of the composition, (C) a metallic detergent in an amount of 0.03 to 0.5 percent by mass in terms of metal, (D) an ashless dispersant in an amount of 0.005 to 0.15 percent by mass in terms of nitrogen and (E) zinc dithiophosphate in an amount of 0.02 to 0.3 percent by mass in terms of phosphorus, wherein the lubricating base oil (A) comprises components (A1) and (A2), wherein (A1) is present in an amount of 70 to 97 percent by mass and (A2) is present in an amount of 3 to 30 percent by mass, based on the total mass of the lubricating base oil, and wherein (A1) comprises a mixture of (Ala) a mineral oil with a kinematic viscosity at 100° C. of from 1.5 to lower than 4.5 $mm^2/s$ and (A1b) a mineral base oil with a kinematic viscosity at 100° C. of from 4.5 to lower than 7 $mm^2/s$, and wherein (A2) comprises (A2b) a mineral or synthetic base oil with a kinematic viscosity at 100° C. of from 15 to lower than 25 $mm^2/s$, and wherein the Component (B) comprises Component (B1) comprising a poly(meth)acrylate containing only a structural unit represented by formula (1):

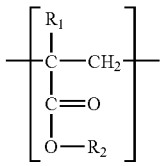

(1)

wherein $R_1$ is hydrogen or methyl, $R_2$ is a hydrocarbon group having 5 to 20 carbon atoms or a moiety represented by —$(R)_n$-E wherein R is a alkylene group having 5 to 20 carbon atoms, E is an amine moiety or heterocyclic moiety having 1 or 2 nitrogen atoms and 0 to 20 oxygen atoms, and a is an integer of 0 or 1, wherein the Component (B) further comprises (B2) a poly(meth)acrylate additive which is a copolymer comprising a structural unit represented by formula (2) below and a structural unit represent by formula (2') below, (2)

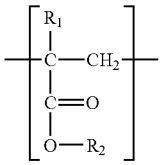

wherein $R_1$ is hydrogen or methyl and $R_2$ is methyl;

(2′)

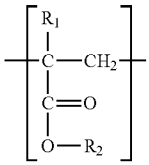

wherein $R_1$ is hydrogen or methyl and $R_2$ is a branched alkyl group having 20 to 28 carbon atoms, and wherein the composition further comprises at least one extreme pressure additive selected from the group consisting of phosphorus acid esters and sulfur extreme pressure additives selected from the group consisting of sulfurized fats and oils and polysulfides in an amount of 0.005 to 0.2 percent by mass in terms of phosphorus or in an amount of 0.01 to 2 percent by mass in terms of sulfur, based on the total mass of the composition, and a NOACK evaporation loss of the composition is less than 12 percent by mass.

2. The lubricating oil composition according to claim 1, wherein the Component (B1) has a weight average molecular weight of 50,000 to 300,000.

3. The lubricating oil composition according to claim 1, wherein the Mw/Mn of the Component (B1) is 1.5 or greater.

4. The lubricating oil composition according to claim 1, wherein the Component (B) further comprises (B2) a poly (meth)acrylate additive containing at least a structural unit represented by formula (2):

(2)

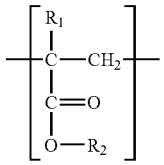

wherein $R_1$ is hydrogen or methyl and $R_2$ is methyl.

5. The lubricating oil composition according to claim 1, wherein Component (A) has a kinematic viscosity at 100° C. of from 4.5 to 6 $mm^2/s$.

6. The lubricating oil composition according to claim 1, wherein the composition has a kinematic viscosity at 100° C. of from 3 to 7 $mm^2/s$.

7. The lubricating oil composition according to claim 1, wherein Component (E) is contained in an amount of 0.12 to 0.18 percent by mass in terms of phosphorus based on the total mass of the composition.

8. The lubricating oil composition according to claim 1, wherein the Component (B2) has a weight average molecular weight of 10,000 to 600,000.

* * * * *